US005918357A

United States Patent [19]

Pennell

[11] Patent Number: 5,918,357

[45] Date of Patent: Jul. 6, 1999

[54] SHOE RACK FACILITATING REMOVAL OF SPIKES AND METHOD

[76] Inventor: William Ray Pennell, 271 Allendale La., Taylorsville, N.C. 28681

[21] Appl. No.: 08/850,617

[22] Filed: May 2, 1997

[51] Int. Cl.[6] ..... B23P 19/00

[52] U.S. Cl. ..... 29/426.1; 29/281.1; 269/15

[58] Field of Search ..... 29/426.1, 426.5, 29/281.1, 281.4; 269/15, 76, 57; 12/128 R, 133 R, 122; 211/205, 196, 37

[56] References Cited

U.S. PATENT DOCUMENTS

| | | | |
|---|---|---|---|
| 508,055 | 11/1893 | Shipherd | 269/15 |
| 551,997 | 12/1895 | Parker | 12/122 |
| 613,133 | 10/1898 | Fobare . | |
| 1,030,940 | 7/1912 | Subberg | 211/35 |
| 1,085,679 | 2/1914 | Gross | 12/122 |
| 1,270,496 | 6/1918 | Cimaglia | 269/15 |
| 1,404,555 | 1/1922 | Smith | 211/35 |
| 1,737,012 | 11/1929 | Jorgensen | 12/122 |
| 2,031,868 | 2/1936 | Toscano | 12/122 |
| 2,466,406 | 4/1949 | Freeman | 12/126 |
| 2,729,341 | 1/1956 | Freeman | 211/37 |
| 2,990,969 | 7/1961 | Rafferty | 211/35 |
| 3,587,865 | 6/1971 | Phillips | 211/37 |
| 3,589,522 | 6/1971 | Chiodo | 211/34 |
| 3,762,573 | 10/1973 | Collins et al. | 211/34 |
| 4,140,306 | 2/1979 | Wheeler | 269/15 |
| 4,710,997 | 12/1987 | Hermida . | |
| 5,406,717 | 4/1995 | Dofka | 211/37 |
| 5,458,243 | 10/1995 | McBride | 211/205 |

*Primary Examiner*—David P. Bryant

[57] ABSTRACT

A shoe rack includes a stand supporting at least one shoe mount over a removable bin. Each shoe mount may be connected to the stand by a strut so that the sole of a shoe placed around a shoe mount is presented in a position convenient for removal of cleats. A shoe mount is shaped so as to prevent substantial rotation of the shoe in reaction to the turning of a cleat. Removed cleats and debris collected in the bin may be disposed by removal and emptying of the bin. Several shoe mounts may be used to accommodate shoes of different sizes.

7 Claims, 1 Drawing Sheet

SHOE RACK FACILITATING REMOVAL OF SPIKES AND METHOD

BACKGROUND OF THE INVENTION

This invention relates to shoe stands or racks.

A shoe generally comprises a sole and an upper. Many athletic shoes are provided with cleats which are removably attached to the sole. The cleats help to anchor the shoe to the turf when the wearer engages in an activity taking place outdoors. The wearer thereby obtains better traction and control.

In times past, cleats typically were formed of metal. More recently, plastic cleats have become more widely used. Many golf courses and softball leagues now forbid the use of metal cleats, requiring replacement of metal cleats by plastic cleats.

A modern athletic shoe cleat sometimes is provided with an externally threaded post which engages with an internally threaded socket provided on the bottom of the sole. The cleat is attached to the sole by screwing the cleat into the socket. By unscrewing the cleat, the cleat may be removed.

When cleats are to be removed, the athletic shoe may be held between the knees to prevent rotation of the sole while the cleats are unscrewed. The removed cleats, along with debris caked onto the sole between the cleats, then fall to the floor. After the new cleats are fastened to the sole, the removed cleats and debris must be swept into a dust pan and emptied. The person performing this process must remain in a rather uncomfortable position while the work is being done, and the debris often stains that person's clothing as well.

SUMMARY OF THE INVENTION

It is therefore an object of the invention to provide a shoe rack capable of holding one or more athletic shoes such that the sole is presented to the user at a convenient height and position for removal of cleats.

Another object of the invention is to hold the shoe or shoes in a manner such that the shoe is prevented from rotation while a cleat is being removed.

Another object of the invention is to provide a removable bin which is positioned to catch the removed cleats and accompanying debris.

These and other objects are provided by a shoe rack comprising a stand supporting one or more shoe mounts over a removable bin. The stand may comprise a generally upright portion including a base member supporting the bin and an upper member supported for rotation on said base member. Each of a plurality of struts may be mounted between the upper member and a shoe mount. Each strut extends in a generally outward direction from the upper member. Each shoe mount is shaped so as to prevent substantial rotation of the sole of a shoe which is received therearound. Therefore, when a cleat is screwed onto or screwed off of the shoe sole, the shoe is prevented from rotating in reaction to the force exerted on the sole by the cleat post.

Each shoe mount may be provided with a shape which differs from the shapes of the other shoe mounts in order that the rack may easily accommodate shoes of different sizes. A fastening member may be used to secure the upper member from the base member when a shoe mount is in the position desired by the user.

The bin may comprise a receptacle and a leaf extending outwards from the receptacle rim.

BRIEF DESCRIPTION OF THE DRAWINGS

In order to facilitate a better understanding of the characteristics of the invention to those skilled in the art, a detailed description will be made on the basis of the accompanying drawing. The drawing is not necessarily drawn to scale.

The sole

DETAILED DESCRIPTION

Figure 1:
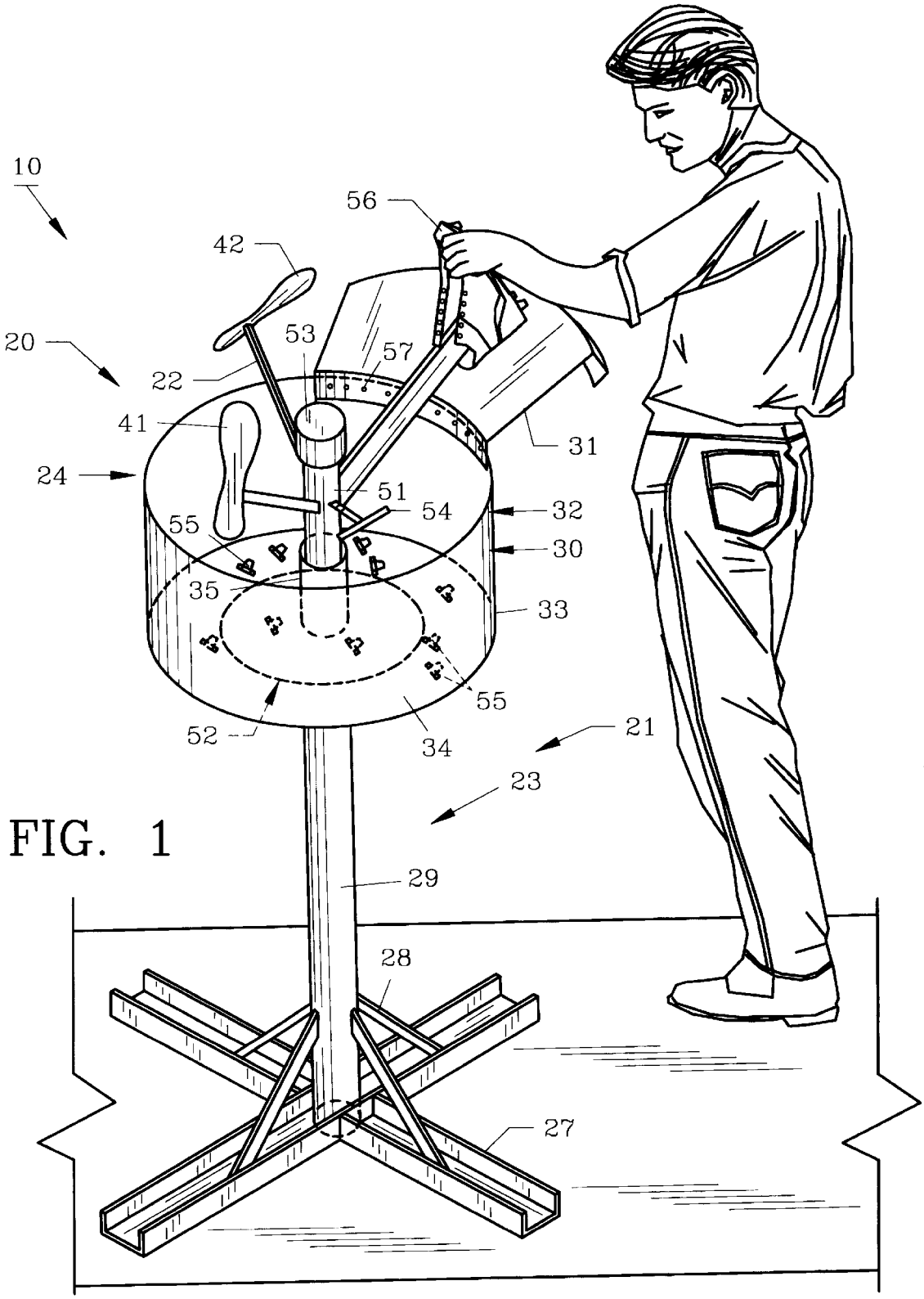
FIG. 1 shows a perspective view of a shoe rack according to a preferred embodiment of the invention.

The shoe rack 10 illustrated comprises a stand 20; a bin 30; and shoe mounts 41 and 42. (A third shoe mount is covered by shoe 56.) Stand 20 comprises an upright portion 21 and a plurality of struts 22 extending generally outward therefrom.

Upright portion 21 comprises a base member 23 and an upper member 24.

Base member 23 includes a plurality of horizontally extending feet 27, an upright first pipe 29, and a plurality of braces 28. Each brace 28 is mounted to a foot 27 and the first pipe 29. Feet 27 may be formed from 1 inch×1 inch×2 inch metal channel. Braces 28 may be formed from ⅛ inch thick flat steel which is 1 inch wide. First pipe 29 may be formed from ⅛ inch thick steel tubing forming a pipe 2⅛ inches in diameter. First pipe 29, braces 28, and feet 27 are mounted by welding. First pipe 29 may be inserted through a hole in a metallic bearing plate 52, and bearing plate 52 then may be welded to first pipe 29.

Bearing plate 52 supports bin 30, which comprises a receptacle 32 and a leaf 31 extending in a generally outward direction from receptacle 32. Receptacle 32 may be formed from molded plastic and includes a sidewall 33, bottom 34, and a bushing 35 which slips over first pipe 29. Leaf 31 may be formed from molded plastic. Leaf 31 may be integral with receptacle 32 or secured thereto by any suitable fasteners such as metal brads 57.

The upper member 24 may include a second pipe 51 which is formed of metal. The inner diameter of second pipe 51 is slightly larger than the outer diameter of first pipe 29 so that second pipe 51 slips around first pipe 29 when upright portion 21 is assembled. Second pipe 51 may rest on the bottom of receptacle 32, or second pipe 51 may include an upper flange to act as a mechanical stop against first pipe 29. A plastic cap 53 may be provided to cover the pipe interior if desired. A fastener (discussed below) may be secured to adjust the height of upper member 24 as well.

A plurality of metallic struts 22 may be extend outward from second pipe 51. Each strut 22 has a proximal end welded to second pipe 51 and a distal end welded to a shoe mount. The shoe mounts 41, 42, (the third shoe mount being hidden from view by shoe 56) may be formed in the shape of a shoe sole as illustrated, or may form all or part of a foot profile, in the manner of a last. Each shoe mount is sized differently from the others so that differently sized shoes may be accommodated on the rack. The shoe mounts and struts are positioned so that the shoes are presented sole-upwards in a position convenient for removal and replacement of cleats. The term sole-upward includes both presentation of a sole in an upward horizontal position and presentation of a sole in an angled upward position as illustrated in the drawing. It is believed that an angled upward position promotes worker access and allows cleats and debris upon removal to fall naturally away from the shoe under the influence of gravity. It also is possible for the shoe mount to present the shoe sole in a vertical position. In any case, no wall members should abut the sole, so that free access is allowed to the sole.

The shoe mounts may assume any of a variety of shapes, so long as the sole of a cleated shoe mounted thereon is prevented from substantial rotation in reaction to the force exerted on the sole by a cleat being screwed into or unscrewed from the sole. While a single-piece shoe mount in the shape of a sole has a suitable shape, others, such as a two-piece heel and toe assembly, also may be used.

A fastener, such as externally threaded bolt 54 engaging an internally threaded hole in second pipe 51, may be unfastened to allow second pipe 51 to rotate on first pipe 29 until the shoe mount desired is over bin leaf 31. The bolt handle is then turned to secure second pipe 51 from further rotation. An athletic shoe 56 then is placed over the desired shoe mount. With leaf 31 positioned between receptacle 32 and the worker, the worker then unscrews cleats 55 from the athletic shoe 56. The cleats 55 and accompanying debris are allowed to fall onto leaf 31 and slide into receptacle 32. By removing second pipe 51 from first pipe 29, the worker may remove bin 30 to dispose of the debris and unwanted cleats. Bin 30 then may be placed back onto plate 52 and second pipe 51 placed over first pipe 29.

If bin 30 is formed to have a crack in its side wall, bottom, and bushing, it then becomes possible to remove bin 30 for emptying without removal of second pipe 51. Of course, material fatigue in the plastic material forming bin 30 due to repeated bending of the plastic during removal and replacement of the bin 30 could shorten its useful life.

Since the invention may be embodied in several forms without departing from the spirit or essential characteristics thereof, the preceding description is intended to be illustrative and not restrictive, since the scope of the invention is defined by the claims rather than by the description preceding them.

What is claimed is:

1. A shoe rack for supporting at least one shoe having a cleated sole, said shoe rack comprising:

a stand including a generally upright portion and at least one strut mounted to said upright portion, said strut extending in a generally outward direction from said upright portion;

a shoe mount mounted to a free end of said strut, said shoe mount being shaped so as to prevent substantial sole rotation of a shoe received around said shoe mount responsive to the turning of a cleat being mounted to or dismounted from said shoe; and a bin removably mounted on said stand beneath said shoe mount for collecting cleats or debris which may fall from said shoe as said cleats are mounted to or dismounted from said shoe.

2. The shoe rack as recited in claim 1, wherein said bin comprises a receptacle supported by said stand upright portion and a leaf extending in a generally outward direction from said receptacle.

3. The shoe rack as recited in claim 1, wherein said stand upright portion comprises a base member and an upper member supported for rotation on said base member, said strut being mounted to said upper member.

4. The shoe rack as recited in claim 3, further comprising a fastener threaded through a hole in said upper member which may be tightened against said base member to prevent rotation of said upper member on said base member.

5. The shoe rack as recited in claim 3, wherein said bin is supported by said base member.

6. The shoe rack as recited in claim 1 comprising a plurality of shoe mounts with differing shapes.

7. A method of removing and disposing of shoe cleats mounted to the sole of a cleated shoe, said method comprising:

providing a shoe rack comprising a stand, a strut mounted to said stand and extending therefrom in a generally outward direction, a shoe mount mounted to a free end of said strut, and a bin removably mounted to said stand beneath said shoe mount;

placing a cleated shoe around said shoe mount;

removing the shoe cleats from the sole of the cleated shoe and allowing the removed cleats to fall into the bin; and as necessary, removing the bin from the stand and emptying the bin to dispose of the removed cleats and any debris collected therein.

* * * * *